US006409419B1

(12) United States Patent
Hernandez

(10) Patent No.: US 6,409,419 B1
(45) Date of Patent: Jun. 25, 2002

(54) REMOVABLE SECURITY POST ASSEMBLY

(76) Inventor: Rigoberto Hernandez, 5371 W. 4 Ct., Hialeah, FL (US) 33012

( * ) Notice: Subject to any disclaimer, the term of this patent is extended or adjusted under 35 U.S.C. 154(b) by 0 days.

(21) Appl. No.: 09/693,874

(22) Filed: Oct. 23, 2000

(51) Int. Cl.[7] ..... E06B 11/00
(52) U.S. Cl. ..... 404/6; 49/131
(58) Field of Search ..... 404/6, 11; 49/35, 49/131; 256/DIG. 5

(56) References Cited

U.S. PATENT DOCUMENTS 3,660,935 A * 5/1972 Boots ..... 49/35
3,698,135 A * 10/1972 Boots et al. ..... 49/35
4,003,161 A * 1/1977 Collins ..... 49/35
4,062,149 A * 12/1977 Collins ..... 49/49
4,715,742 A * 12/1987 Dickinson ..... 404/6
5,192,159 A * 3/1993 Higginson ..... 404/11
5,365,694 A * 11/1994 Macaluso ..... 49/49
5,441,359 A * 8/1995 Filippi ..... 404/6
5,474,017 A * 12/1995 Mohebbi et al. ..... 116/209
5,509,754 A * 4/1996 Conigliaro ..... 404/9
5,520,479 A 5/1996 Hernandez
5,961,249 A * 10/1999 Hansen et al. ..... 404/9
6,099,200 A * 8/2000 Pepe et al. ..... 404/6

* cited by examiner

*Primary Examiner*—Gary S. Hartmann

(57) ABSTRACT

A removable post assembly for securing an area, basically comprising an anchorage assembly, an elongated post member and a locking assembly to lock and secure the removable post member to the anchorage assembly. The anchorage assembly includes housing with an upper opening adjacent to the ground level to cooperatively receive a portion of the elongated post member. The housing has cavities or bay members to selectively receive a latching member of the locking assembly. The elongated post member is tubular and includes lateral openings positioned at its lowermost portion, that once the former is placed inside the housing of the anchorage assembly, the lateral openings are in horizontal alignment with the bay members to allow the piercing of the latching member. The locking assembly includes a lock mounted to the upper end of the post member.

5 Claims, 4 Drawing Sheets

REMOVABLE SECURITY POST ASSEMBLY

BACKGROUND OF THE INVENTION

1. Field of the Invention

The present invention relates to a post for securing an area, and more particularly, to the type that is removably anchored to the ground.

2. Description of the Related Art.

The closest reference with characteristics similar to the present invention corresponds to U.S. Pat. No. 5,520,479 issued in 1996 to the same applicant Rigoberto Hernandez. The present invention discloses improvements to the previous patent, specifically, in the locking and anchorage assemblies.

SUMMARY OF THE INVENTION

It is one of the main objects of the present invention to provide security post assembly that is removable, and when removed does not leave any irregularities on the ground.

It is another object of this invention to provide a security post assembly that has such an internal locking mechanism that provides no access to a wrongdoer.

It is still another object of this invention to provide a security post assembly that is easy to operate by a user.

It is yet another object of this invention to provide such a device that is inexpensive to manufacture and maintain while retaining its effectiveness.

Further objects of this invention will be brought out in the following part of the specifications, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
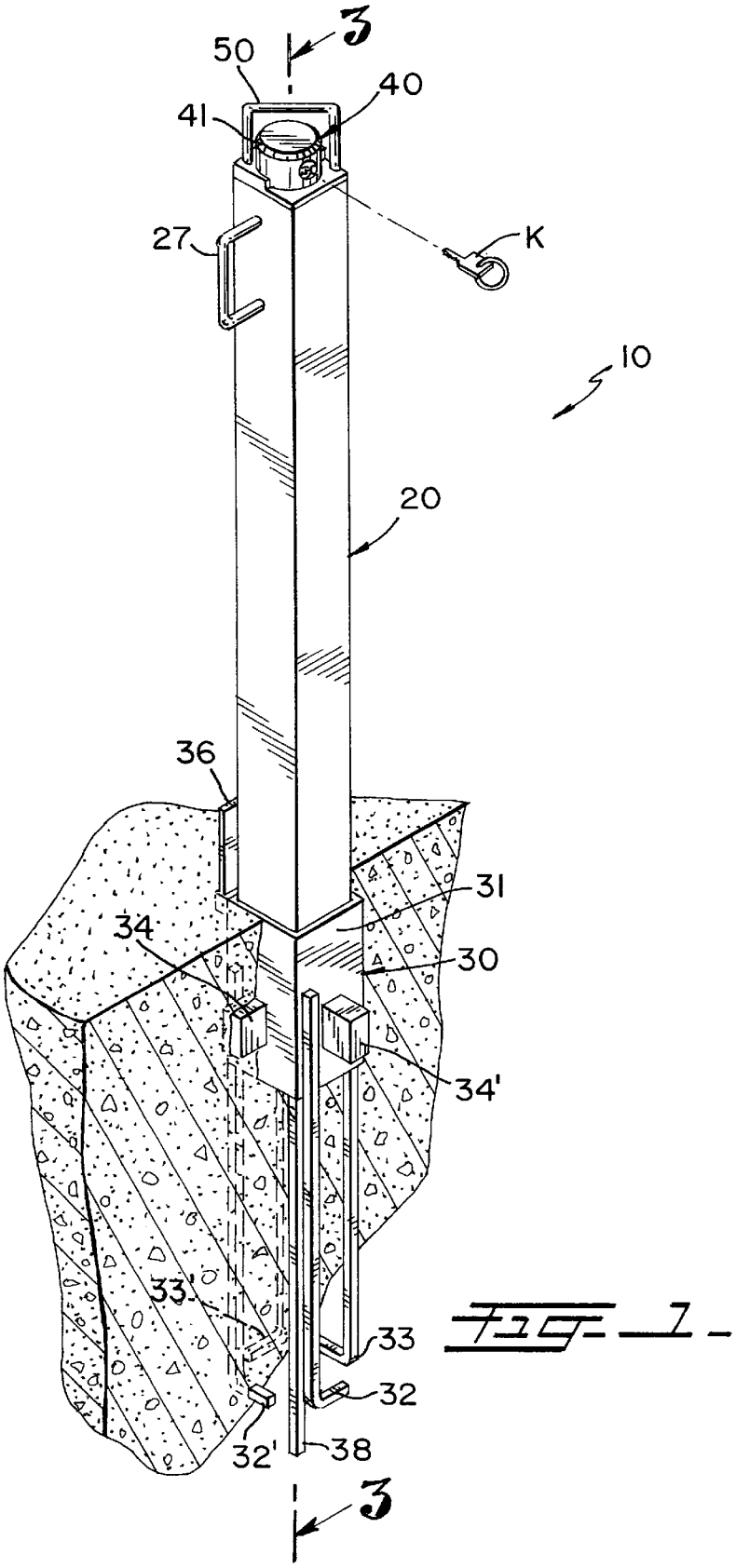
FIG. 1 is an isometric view of the preferred embodiment.

Referring to the drawings in detail and initially to FIG. 1 thereof, it will be seen that removable security post assembly 10 basically includes elongated post member 20 removably mounted to anchorage assembly 30, and secured in place by locking assembly 40.

Figures 3, 3A:
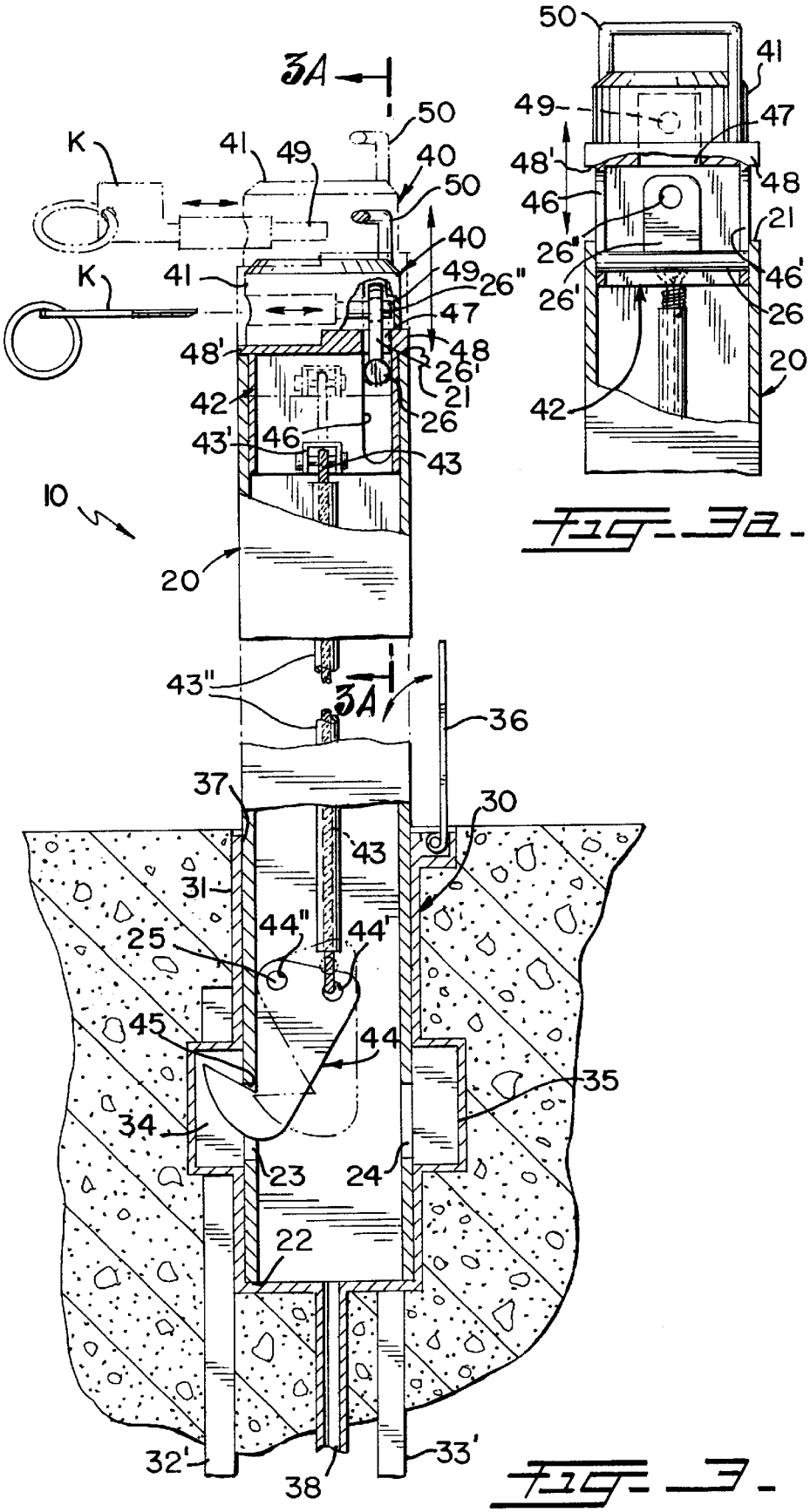
FIG. 3 is a partial cross-sectional view of the present invention, taken along line 3—3. This figure shows the displacement of the locking mechanism.
FIG. 3A is a partial cross-sectional view of this invention, taken along line 3A—3A.

As illustrated in FIGS. 1, 3 and 3A, elongated post member 20 is tubular and has a rectangular cross section. Post member 20 has upper and lower opened ends 21 and 22, respectively. Upper opened end 21 cooperatively receives locking assembly 40, as best seen in FIG. 3. Post member 20 is maintained vertically by housing member 31 of anchorage assembly 30, inside which post member 20 penetrates a sufficient distance to be secured to the ground. As shown in FIG. 3, post member 20 also has lateral openings 23, 23', 24 and 24' disposed in the lowermost section thereof. Post member 20 also includes pin members 25 and 26 rigidly mounted to the walls thereof. Pin members 25 and 26 are located inside tubular member 20. Pin member 25 is located in the lowermost portion of post 20 and is designed to hold a predetermined section of latching member 44 in place so that the latter will pivot about pin 25. Pin member 26 is located in the uppermost portion of post member 20. Pin member 26 has eye plate 26' rigidly and perpendicularly mounted thereto. Eye plate 26' has, at its distal end, eyelet 26" that cooperatively receives locking pin 49 of padlock 41 through, as best shown in FIGS. 3 and 3A. Post member 20 also includes handle 27 that is suitable to a user to manipulate the former.

Figure 4:
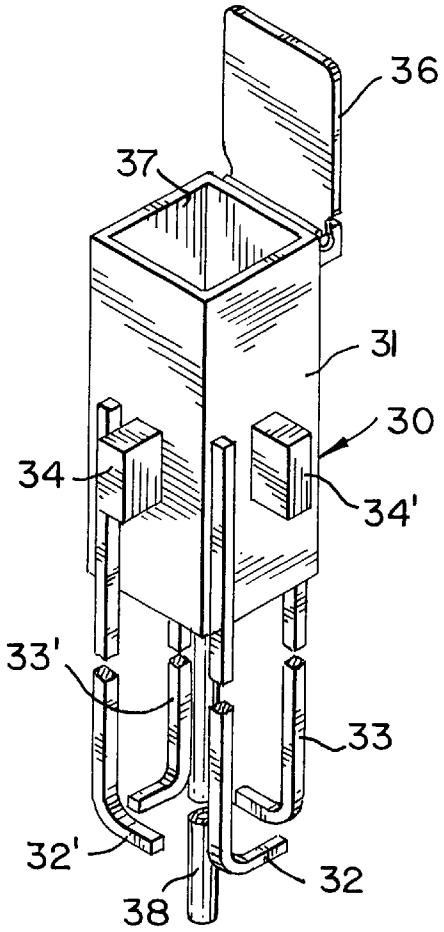
FIG. 4 is an isometric view of the anchorage assembly of the preferred embodiment.

Anchorage assembly 30, as illustrated in FIGS. 1, 3 and 4, basically includes housing 31, anchorage members 32, 32', 33 and 33', cavities or bay members 34, 34', 35 and 35', and cover member 36. Anchorage assembly 30 is permanently installed below ground level in such manner that only opening 37 of housing 31 and cover member 36 are visible. Anchorage members 32, 32', 33 and 33' are rigidly mounted to the lateral walls of housing 31 and are designed to provide firm support to anchorage assembly 30. Cover member 36 is pivotally mounted the upper end of housing 31 so that when post member 20 is removed, member 36 covers opening 37 thereby leaving no irregularities on the ground. When post member 20 is placed inside anchorage assembly 30, lateral openings 23, 23', 24 and 24' are in horizontal alignment with bay members 34, 34', 35 and 35', respectively. Cavities or bay members 34, 34', 35 and 35', in the preferred embodiment, are outwardly and perpendicularly projected with respect to housing 31. Anchorage assembly 30 also includes drainage passage 38 located in the bottom of housing 31. In this manner, the water trapped inside housing 31 flows away through drainage passage 38.

Locking assembly 40, in the preferred embodiment, includes padlock assembly 41 rigidly mounted to tubular housing 42 that in turn is mounted to upper opened end 21 of post member 20. As best seen in FIG. 3, extended cable 43 is mounted, at one end, to tubular housing 42 by fastening member 43' and latching member 44 is attached to the other end. Cable 43, in the preferred embodiment, is made out of metallic material and is tension-resistant. Cable 43 has cover 43" to protect the former. Latching member 44 has eyelet 44' through which one end of cable 43 is attached. Eyelet 44' is located at the right and uppermost portion of latching member 44 and latching notch 45 is located at the left and lowermost portion thereof. Latching member 44 also includes eyelet 44" disposed adjacent to eyelet 44". Eyelet 44" cooperatively receives pin 25 of post member 20. Padlock assembly 41 is manufactured by American Lock Company The Locksmith's Lock ® located at 3400 W Exchange Road Crete Ill. 60417 USA. Tubular housing 42 includes lateral slots 46 and 46', and upper slot 47. Slots 46 and 46' are located in two opposite lateral walls of housing 42 and receive pin member 26 through. Slots 46 and 46' limit the vertical displacement of housing 42 inside post member 20. Slot 47 is located in top wall 48 of housing 42 and is designed to receive eye plate 26' through.

Once a user anchors removable post member 20 in the ground, it is locked by locking assembly 40. A user brings padlock assembly 41 towards post member 20, housing 42 and cable 43 descend until edge 48' stops against upper end 21. Then, padlock assembly 41 is actuated with key K and locking pin 49 is inserted in eyelet 26" and secured in placed. Cable 43 moves down and latching member 44 pivots about fixed pin 25. Cable 43 descends sufficiently to allow latching notch 45 be inserted through lateral openings 23, 23', 24 and 24' in any of bay members 34, 34', 35 or 35'. In this manner, post member 20 is firmly secured to anchorage assembly 30.

Once a user desires to remove post member 20 from the ground, he/she unlocks padlock assembly 41 aided by key K and locking pin 49 is removed from eyelet 26", as best seen in FIG. 3. The user helped by handle 50, lifts padlock assembly 41 along with housing 42 until fixed pin 26 stops against the lower end of lateral slots 46 and 46', as seen in FIG. 3A. When cable 43 is pulled up, latching member 44 pivots about fixed pin 25 and latching notch 45 is removed from any of bay members 34, 34', 35 or 35', as best shown in FIG. 3.

Figure 2:
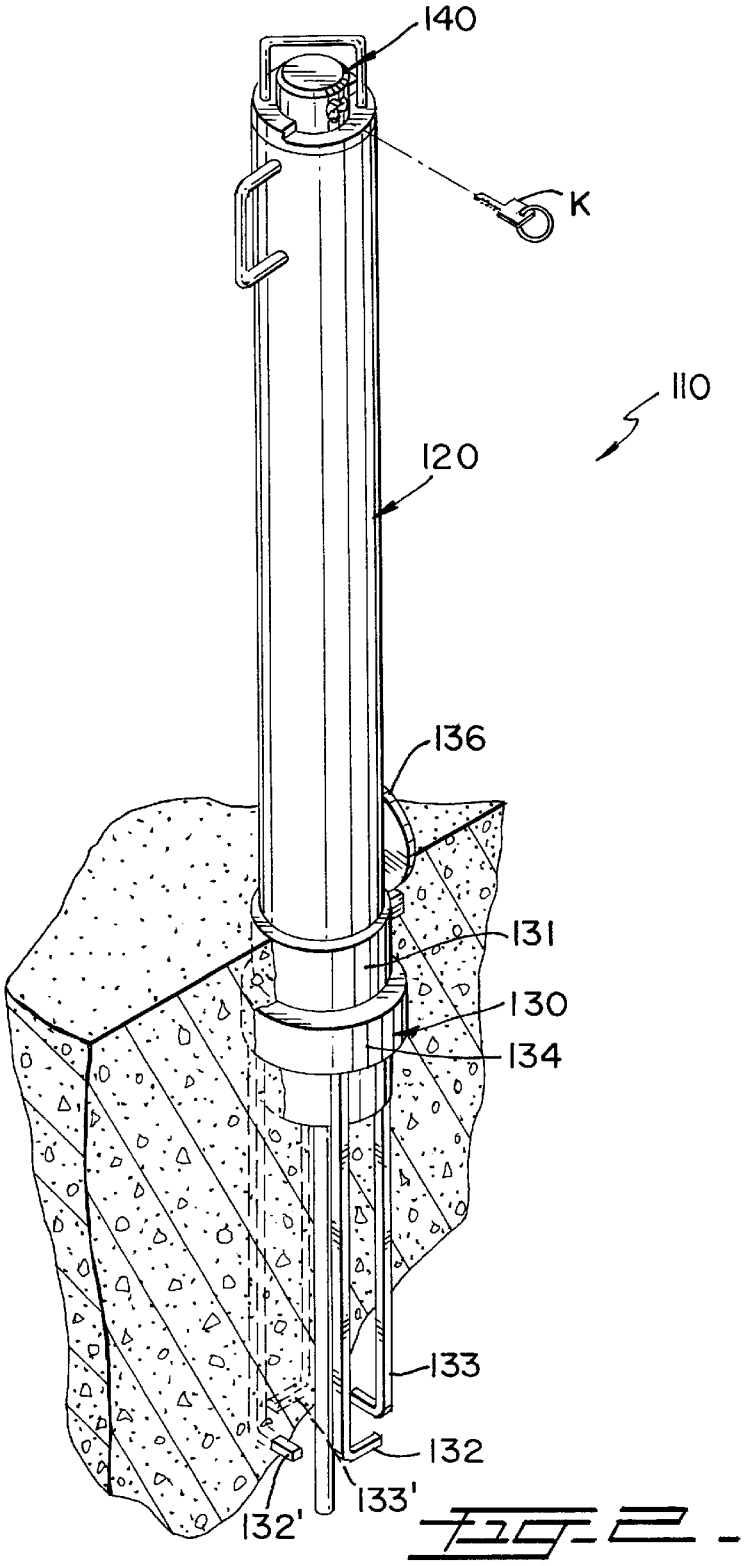
FIG. 2 is an isometric view of an alternative embodiment.
Figure 5:
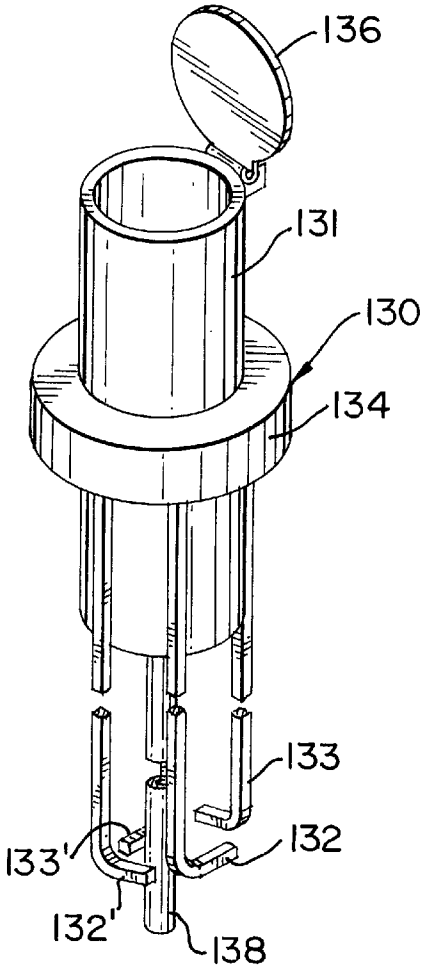
FIG. 5 is an isometric view of the anchorage assembly of the alternative embodiment.

FIGS. 2 and 5 illustrate alternative embodiment 110 that is similar to embodiment 10. Removable security assembly 110 includes post member 120 removably mounted to anchorage assembly 130 and secured in place by locking assembly 140. Both post member 120 and anchorage assembly 130 have circular cross section. Anchorage assembly 130 basically includes housing 131, anchorage members 132, 132', 133 and 133', bay 134 and cover member 136. Bay or cavity 134 is disposed around the circular lateral wall of housing 131.

The installation of anchorage assemblies 30 and 130 is accomplishes by pouring concrete around anchorage members 32, 32', 33, 33' and 132, 132', 133, 133', respectively.

The foregoing description conveys the best understanding of the objectives and advantages of the present invention. Different embodiments may be made of the inventive concept of this invention. It is to be understood that all matter disclosed herein is to be interpreted merely as illustrative, and not in limiting sense.

What is claimed is:

1. A removable security post assembly, comprising:

an anchorage assembly positioned below ground level and including first housing means having first and second ends and said first end being an opening adjacent to the ground level, and said anchorage assembly further includes anchorage means rigidly mounted to said first housing means, and wherein said first housing means has at least one bay member that is outwardly and perpendicularly projected with respect to said first housing means, an elongated post member removably and partially received within said first housing means, said elongated post member is tubular having first and second opened ends, and said elongated post member further includes at least one lateral opening, that once the former is placed inside said first housing means, said lateral opening is in horizontal alignment with said bay member, a second housing means mounted to said first opened end of said elongated post member and is slidably received inside said elongated post member, and a locking assembly including a lock for securing said elongated post member to said anchorage assembly, said locking assembly is mounted to said second housing means, and once a user actuates said locking assembly, the latter along with said second housing means slide downwardly and inside said post member.

2. The removable security post assembly set forth in claim 1 wherein said second housing means includes a cable extended and holding at its distal end a latching member.

3. The removable security post assembly set forth in claim 2 wherein said latching member includes latching means inserted in said bay member through said lateral opening so that said elongated post member is firmly anchored to said anchorage assembly, and said latching member pivots about a pin member, which is rigidly mounted to said tubular post member, when said locking assembly is actuated.

4. The removable security post assembly set forth in claim 3 wherein said anchorage assembly further includes drainage means through which the water trapped inside said first housing means flows away.

5. The removable security post assembly set forth in claim 4 wherein said anchorage assembly further includes means for covering said opening of said first housing means, once said elongated post member is removed from the ground.

* * * * *